United States Patent [19]

Jamieson, Jr.

[11] 4,125,251

[45] Nov. 14, 1978

[54] UNIVERSAL CLAMPING SYSTEM

[76] Inventor: Hugh V. Jamieson, Jr., 10555 Inwood Rd., Dallas, Tex. 75229

[21] Appl. No.: 792,879

[22] Filed: May 2, 1977

[51] Int. Cl.[2] ..... B25B 1/10

[52] U.S. Cl. ..... 269/45; 269/88; 269/246; 269/321 A

[58] Field of Search ..... 269/243, 246, 321 A, 269/45, 88

[56] References Cited

U.S. PATENT DOCUMENTS

| | | | |
|---|---|---|---|
| 1,954,708 | 4/1934 | Mass | 269/321 A |
| 2,636,527 | 4/1953 | Schiemann | 269/45 |
| 2,753,902 | 7/1956 | Klee | 269/88 |
| 3,155,384 | 11/1964 | Schwenzer | 269/101 |
| 3,967,816 | 7/1976 | Rampperger et al. | 269/321 A |
| 4,027,866 | 6/1977 | Ruggiero | 269/243 |

*Primary Examiner*—Robert C. Watson
*Attorney, Agent, or Firm*—H. Mathews Garland

[57] ABSTRACT

A universal clamping system connectible in various different configurations permitting a workman to improvise to perform a plurality of holding functions where a work piece is supported between at least two opposing faces by a force applied to the work piece at one of the faces toward the other face. The system includes junction blocks having non-intersecting smooth walled holes extending through the blocks in at least two different directions, threaded connecting rods insertable through the holes in the junction blocks, and nuts for securing the junction blocks on the rods when the rods are disposed through the blocks. One form of the invention also includes a pressure foot for applying the force to a work piece. The pressure foot has a leg portion having a smooth walled blind hole for slidable mounting on a threaded rod, and a transverse slot intersecting the holes to receive a flexible member for holding the pressure foot on the rod. The most simple configuration of the universal clamping system disclosed is a surface clamp including a single junction block, a single threaded rod disposed through one of the holes in the junction block, and a single pressure foot supported on an end of the rod for applying a force to a work piece to hold the work piece at a desired position on a work surface. In other forms of the invention disclosed a plurality of the various components are employed in various configurations to function as a hold-down clamp, a bridge clamp, a bar clamp, and a four-corner clamp. Various shapes of junction blocks are used in the different configurations of the universal clamping system disclosed.

1 Claim, 11 Drawing Figures

UNIVERSAL CLAMPING SYSTEM

This invention relates to clamping systems for holding work pieces and more particularly relates to universal clamping systems which are connectible in a plurality of different configurations for accomplishing different functions in holding work pieces.

A number of hand crafts, particularly woodworking, present many problems involving holding work pieces while performing such tasks as drilling, sanding, and the like. Also, in woodworking it is often necessary to hold several work pieces together while they are being joined such as when gluing. A variety of tools are available for performinng these different tasks such as C-clamps, bar clamps, hold-down clamps, parallel clamps, and others. Each of these clamps is capable of performing only a specific type function. Each of these clamps generally is capable of functioning with work pieces within a somewhat limited size range so that a variety of sizes of work pieces could readily require a number of different sizes of the same type of clamp. Thus, when considered in terms of performing a wide variety of tasks and working with various sizes for each task, a very large number of sizes and different types of clamps may be required. No systems are known which will permit a workman to improvise to discharge both the functions of a variety of clamp types and variations in size requirements.

It is, therefore, a principal object of the present invention to provide a new and improved system of clamping.

It is another object of the invention to provide a universal clamping system employing a minimum of different types of components to discharge a number of different types of functions.

It is another object of the invention to provide a universal clamping system which is useful with work pieces of various sizes.

It is another object of the invention to provide a system for clamping including various components which allow a workman to improvise to provide an almost infinite variety and size of clamping systems for holding work pieces.

In accordance with the invention there is provided a universal clamping system for a workman to improvise to perform a plurality of clamping functions and adapted to a variety of size ranges for each of such functions. Each form of the system permits a force to be applied between spaced opposing surfaces to a work piece between the surfaces to hold the work piece. The clamping system includes junction blocks having smooth walled holes extending in nonintersecting relationship in at least two directions, threaded bars and nuts which are disposed through the holes in the junction blocks and secured to the blocks by the nuts, and, in one preferred form, a pressure foot for use as a force applying member including a leg portion having a smooth walled blind hole adapted to fit on an end of one of the threaded bars and having a transverse recess intersecting the smooth hole permitting a flexible member, such as a rubberband, to pass through the slot engaging threads on the threaded rod for holding the pressure foot on the end of the rod. A variety of shapes of junction blocks with various hole arrangements are provided permitting a substantial number of clamping system configurations utilizing different combinations of the junction blocks, threaded rods, and pressure foot members.

The invention together with its objects and advantages will be better understood from the following detailed description of various preferred embodiments thereof read in conjunction with the accompanying drawings wherein.

Figure 1:
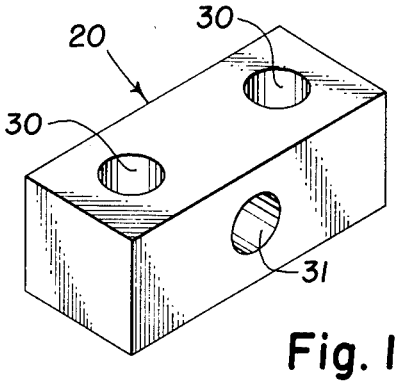
FIG. 1 is a perspective view of the most simple form of junction block employed in the universal clamping system of the invention.
Figure 6:
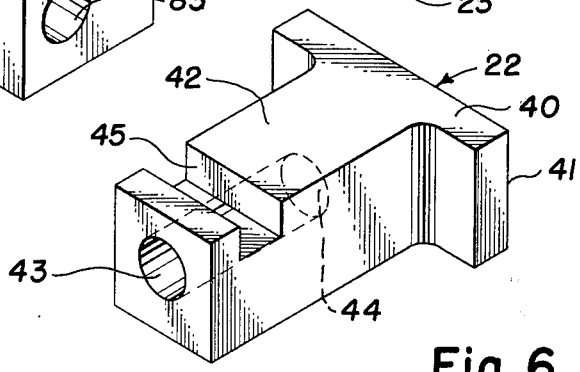
FIG. 6 is a perspective view of a pressure foot used in the system of the invention to apply a force to a work piece being held by the system.
Figure 7:
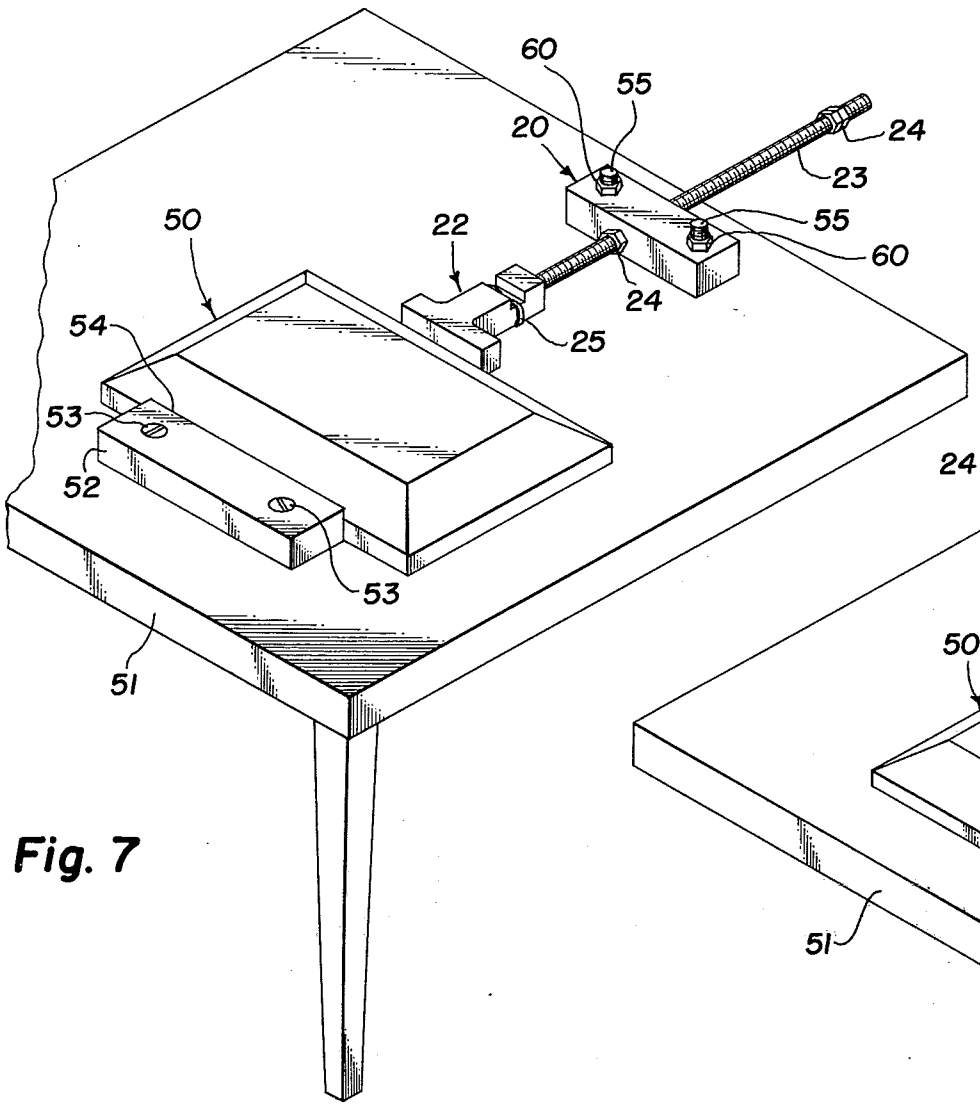
FIG. 7 is a fragmentary perspective view of one of the most simple configurations of the system of the invention functioning as a surface clamp holding a work piece on a work bench.

Referring to FIGS. 1, 6, and 7, a surface clamp configuration of the system of the invention as seen in FIG. 7 includes a junction block 20 shown in FIG. 1, a pressure foot 22 illustrated in FIG. 6, a threaded rod 23, nuts 24, and a flexible band 25. Referring specifically to FIG. 1, the junction block 20 is preferably a solid rectangular member made of a material such as metal, wood, and the like. The junction block has two smooth walled holes 30 extending through the block in parallel spaced relation in a first direction and at least one smooth walled hole 31 extending through the block in a second direction substantially perpendicular to the direction of the holes 30.

The pressure foot 22 shown in FIG. 6 is a solid member formed of metal, wood, or the like having a foot portion 40 provided with a flat pressure surface 41 and an integral leg portion 42 disposed perpendicular to the pressure surface 41. A blind smooth walled hole 43 is provided in the leg portion 42 perpendicular to and extending toward the pressure foot from the end opposite the pressure surface 41. The hole 43 bottoms in the leg portion at 44. A transverse recess 45 is provided extending across the leg portion 42 intersecting the hole 43 to receive the flexible band 25 when the band is stretched around the leg portion of the pressure foot. The flanged foot end 40 of the pressure foot having the pressure surface 41 is substantially wider than the leg portion 42 to provide a large size pressure surface for the force applications required of the pressure foot. The blind hole 43 has a smooth wall so that the pressure foot is self-centering on the threaded rod 23 and the rod can rotate in the foot without relative travel between the rod and foot. It will be recognized that if the bore 43 were threaded the rod 23 could not be rotated to adjust the pressure foot and apply the force required of the pressure foot to properly hold a work piece in place.

As seen in FIG. 7 the surface clamp form of the invention is used for holding a work piece 50 on a work table 51. A stop 52 is rigidly secured by screws 53 to the surface of the work table 51 providing a holding surface 54 along one of the vertical side edge surfaces of the stop 52. In holding the work piece 50 rigidly in place on the work table for performing various work functions, such as drilling and the like, the system of the invention is employed to apply a force with the pressure foot 22 to one edge of the work piece urging the work piece along the other edge against the holding surface 54 of the stop 52. One end of the threaded rod 23 is inserted into the hole 43 of the pressure foot until the end surface of the rod engages the hole bottom 44. Since the wall defining the hole 43 is smooth, the rod 23 is readily inserted fully into the hole of the pressure foot. The band 25, which may be a common rubberband, is stretched around the leg portion 42 of the pressure foot with one portion of the band extending across the pressure foot leg through the transverse recess 45. The band engages the threads on the rod 23 loosely but firmly holding the pressure foot on the rod so that in manipulating the rod to the proper position the pressure foot does not fall from the rod. The use of the loosely fitting relationship between the threaded rod and the smooth hole in the pressure foot and holding the pressure foot on the rod with the rubberband permits the pressure foot to be self-centering so that it will properly seat against the work piece edge. A central portion of the threaded rod 23 extends through the smooth walled hole 31 in the junction block 20. The junction block 20 is secured to the work table 51 by threaded bolts 55 through the holes 30 and nuts 60 which securely fix the block to the work table surface. The junction block is mounted on the work table with the longitudinal axis of the junction block as defined along the length of the block aligned substantially parallel with the corresponding longitudinal axis of the stop 52. In assemblying the clamping system the pressure foot is first placed on the rod 23 as previously described. One nut **24*a* is then threaded on the rod to a position which will place the nut between the junction block 20 and the pressure foot when the system is assembled to hold the work piece 50 in place. The rod 23 is then inserted at the free outer end of the rod through the smooth walled hole 31 of the junction block 20 and the work piece 50 is placed as shown in FIG. 7. The nut 24*a* is then turned on the rod 23 until the nut engages the adjacent face of the junction block 20 and the pressure foot surface 41 lightly engages the adjacent edge of the work piece 50. A pair of nuts 24*b* are rotated together on the free end of the rod 23. A first wrench, not shown, is used to hold the nut 24*a* against rotation at the edge surface of the junction block while the pair of nuts 24*b* on the free end portion of the rod 23 are rotated by a second wrench, not shown, turning the rod 23 in the first nut 24*a* so that the rod 23 travels through the first nut generating a clamping pressure which urges the pressure foot 22 against the work piece 50. By holding the first nut 24*a* while the rod is rotated the nut 24*a* tends to be threaded outwardly on the rod increasing the distance between the nut and the pressure surface 41 of the pressure foot resulting in increasing the pressure applied by the pressure foot to the work piece 50. The slip fit between the end portion of the rod 23 in the smooth hole 43 of the pressure foot 22 allows the rod 23 to freely turn in the pressure foot while the self-centering feature of the relation of the rod and the pressure foot permits the pressure foot to fully engage the work piece for applying the maximum force to the work piece. It will be evident that the rod 23 is turned to the extent desired to apply the degree of pressure required for holding the work piece rigid depending upon the type of work being carried out on the work piece. When the desired work function on the work piece is completed, the rod 23 is rotated in the opposite direction to back the rod away from the junction block 20 to retract the pressure foot for releasing the work piece. It will be recognized that the smooth hole in the junction blocks 20 and the smooth hole in the pressure foot permits the necessary movement of the threaded rod and the centering of the pressure foot without any tightening effect of the rod in the pressure foot since the force required for the functioning of the system is carried by the nut 24 against the edge surface of the junction block 20**.

Figure 2:
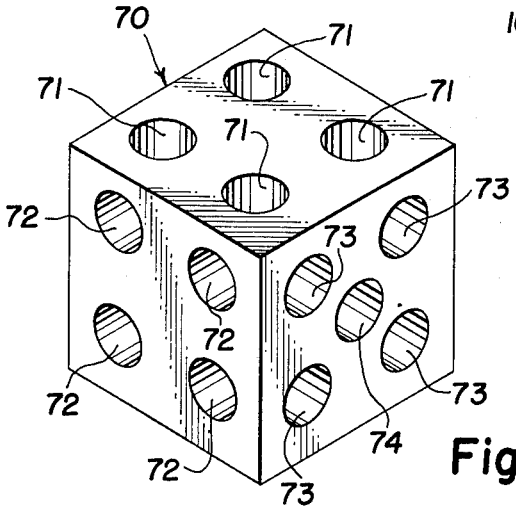
FIG. 2 is a perspective view of another form of junction block employed in the system of the invention.

FIG. 2 illustrates a cube-shaped junction block 70 having four, parallel, spaced, smooth walled holes 71 extending in a first direction parallel along a first axis, four spaced parallel smooth holes 72 extending parallel with a second axis perpendicular to the first holes 71, and a third set of parallel holes 73 and 74 extending along a third axis perpendicular to the first and second axes. The holes 71, 72, and 73 are disposed in intersecting relationships, while the hole 74 extends in a nonintersecting relationship through the cube.

Figure 8:
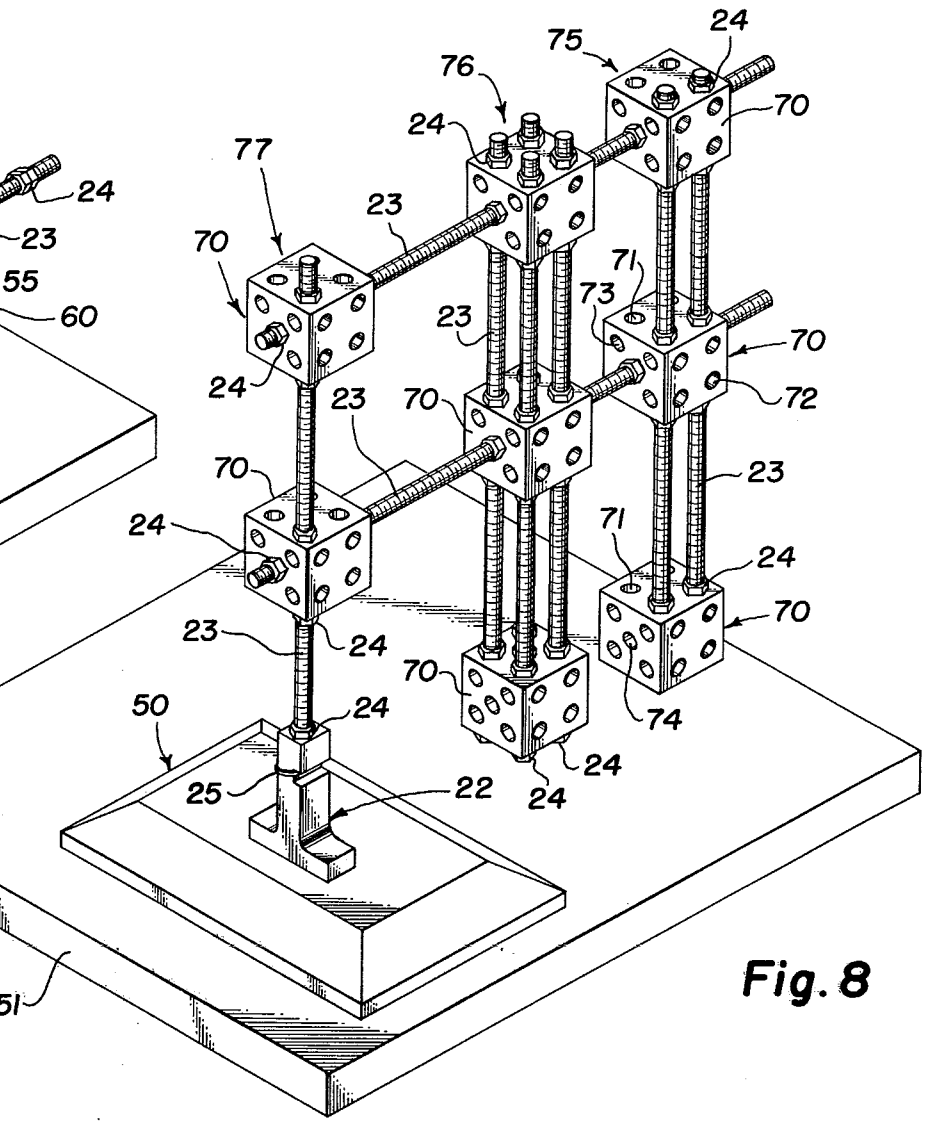
FIG. 8 is a perspective view of a more complex configuration of the system of the invention to perform a hold-down function.

FIG. 8 illustrates a hold-down clamp configuration of the clamping system of the invention utilizing the cube-shaped junction block 70 of FIG. 2. Referring to FIG. 8, the work piece 50 is held on the surface of the work table 51 by the pressure foot 22 which is supported on a vertically aligned threaded rod 23. The system of FIG. 8 uses a cantilever arm arrangement which is secured with and supported from two parallel, spaced columns of threaded rods 23 and junction blocks 70 mounted on the work table. A first vertical column 76 comprising three of the junction blocks 70 secured in vertical spaced relation along two of the threaded rods 23 is connected on the work table 51 by the two threaded rods 23 which extend from the bottom junction block through holes, not shown, provided in the work table. The rods 23 in the column 75 extend through the two of the smooth holes 71 in the blocks 70. The junction blocks 70 are securely fixed along the lengths of the rods 23 by nuts 24 on the rods tightened against the opposite faces of the two upper junction blocks. The nuts 24 tightened against the top surface of the bottom junction block and against the bottom of the work table 51 on the bottom end portions of the rods 23 extending through the work table hold the first column 75 adjacent to the edge of the work table. Two vertically spaced parallel, horizontal threaded rods 23 are secured through the horizontal central holes 74 in the upper two junction blocks of the first column 75. A second column 76 of the junction blocks 70 and threaded rods 23 is secured inwardly of the work table edge spaced from the first column with the upper two junction blocks mounted on the horizontal rods 23 projecting from the upper two junction blocks in the first column. The second column of the junction blocks and the rods includes four of the threaded rods 23 disposed through the four holes 71 of the junction blocks held tightly on the threaded rods by the nuts 24 threaded on the rods tightly against the opposite upper and lower faces of the junction blocks 70. The nuts 24 on the lower ends of the rods 23 in the second column rest on the work surface of the table 51. A third column 77 includes a single threaded rod 23 on which the pressure foot 22 is mounted and vertically spaced middle and upper junction blocks 70 which are also secured on the pair of horizontal rods 23 extending from the first and second columns and tightly secured with the vertical rod 23 by nuts 24. The nonintersecting relationship of the central smooth hole 74 in the junction blocks 70 and the other sets of the smooth holes 71 permits the rods 23 to extend in both the vertical and horizontal directions for forming the cantilever arrangement holding the pressure foot 22. The pressure foot is held on the lower end portion of the rod 23 in the third column 77 over the work piece 50 by the rubberband 25 as previously discussed. After the surface clamp system of FIG. 8 is assembled in the relationship shown with the pressure foot 22 spaced slightly above the work piece 50, the nut 24 on the rod 23 holding the pressure foot is rotated to travel downwardly against the upper end of the leg portion of the pressure foot to apply a downward dorce to the pressure foot urging the pressure foot against the top surface of the work piece. The form of the clamping system shown in FIG. 8 permits a large work piece to be held down on a work table by the cantilever system with the supporting columns removed substantially from the work piece so that a workman has ready access to all four sides of the work piece.

Figure 3:
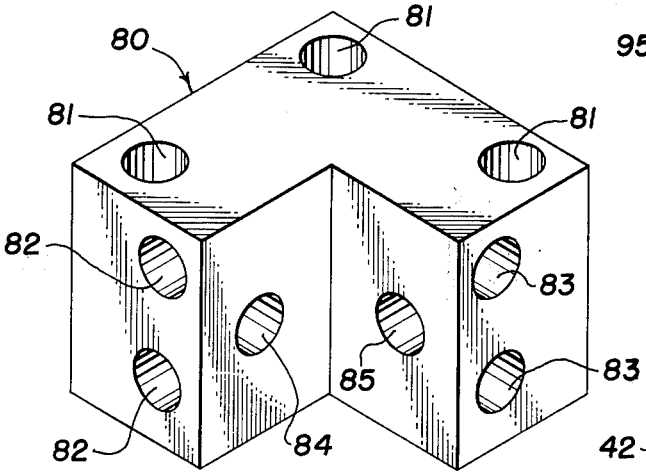
FIG. 3 is a perspective view of a further form of junction block used in the system of the invention.

FIG. 3 illustrates a junction block 80 having an L-shape and provided with three, parallel, spaced smooth walled holes 81 disposed parallel to a first axis, a second set of parallel, smooth walled holes 82 extending parallel with a second axis perpendicular to the first axis, a third set of parallel smooth walled holes 83 extending parallel with each other and parallel to a third axis which is perpendicular to the first and second axes. The junction block 80 additionally has a pair of smooth walled holes 84 and 85 which lie in a common plane along axes perpendicular to each other and to the holes 81. The sets of holes 81, 82 and 83, and 84 and 85 extend in nonintersecting relationships. Only the sets of holes 82 and 83 do intersect. The junction block 80 is useful in forming various configurations of clamping systems embodying the principles of the invention such as the system illustrated in FIG. 9.

Figure 4:
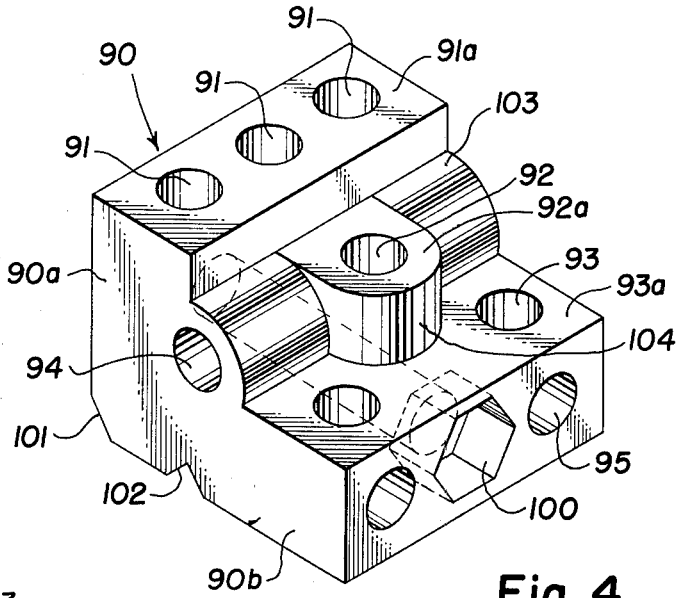
FIG. 4 is a perspective view of a still further form of junction block employed in the system of the invention.
Figure 5:
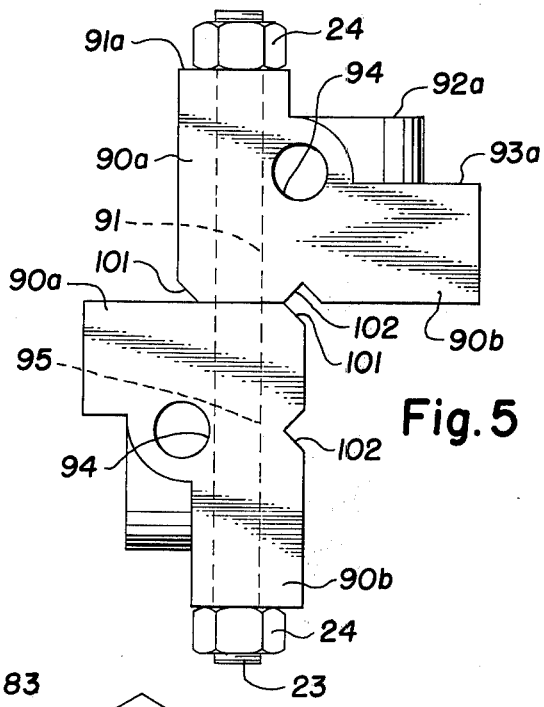
FIG. 5 is a top plan view of two junction blocks as seen in FIG. 4 secured together to form a 90° corner assembly used particularly in a four-corner clamping configuration of the system of the invention.
Figure 9:
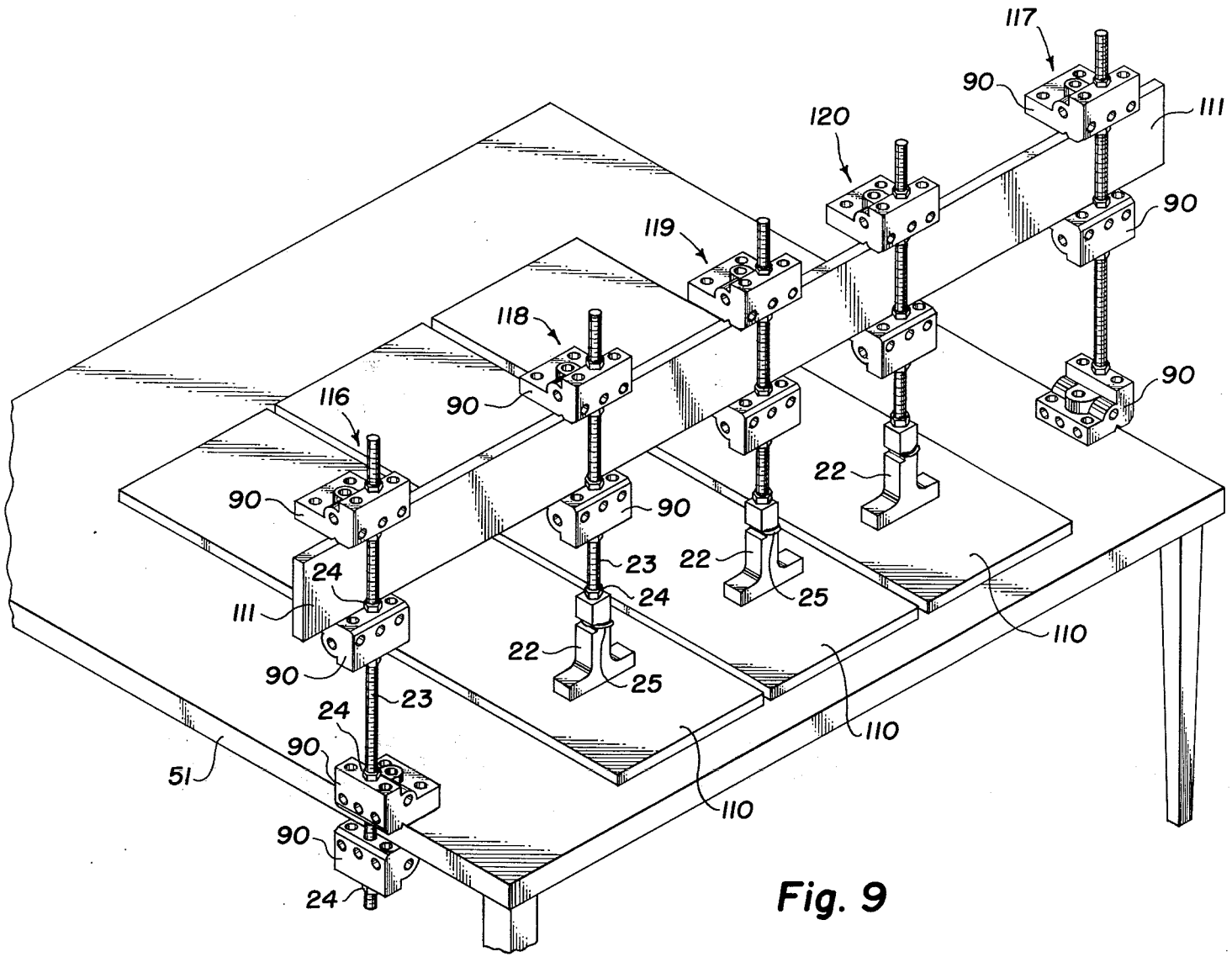
FIG. 9 is a perspective view of a still further configuration of the universal clamping system of the invention arranged as a bridge clamp.
Figure 11:
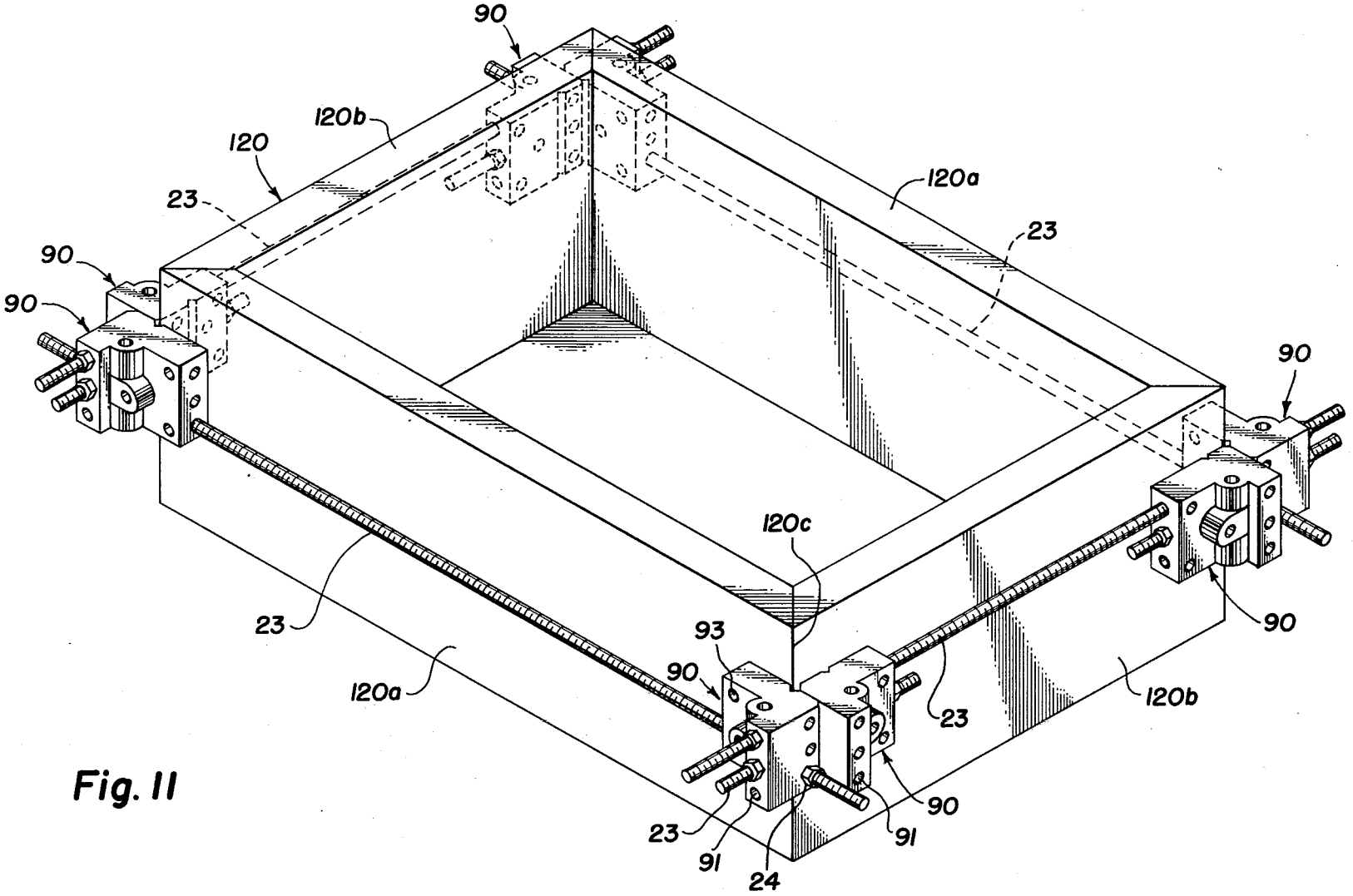
FIG. 11 is a still further arrangement of the system of the invention in the form of a four-corner clamp.

FIGS. 4 and 5 illustrate a further form of junction block 90 which basically has an L-shaped cross-section formed by legs **90*a* and 90*b* providing a design giving the block substantial flexibility in function as evidenced by the combined use of the blocks illustrated in FIGS. 5 and 11 for corner purposes and the use of the blocks in a bridge clamp as illustrated in FIG. 9. The junction block 90 has a first set of parallel holes 91 aligned along a first axis in leg 90*a*, a second hole 92 in the leg 90*b* spaced from and aligned parallel with the holes 91, and a third set of holes 93 in the leg 90*b* spaced from the holes 91 and 92 and parallel to such holes. A fourth hole 94 passes through the block 90 at the inside junction of the legs 90*a* and 90*b* between and perpendicular to the holes 91 and 92 in a nonintersecting relationship. A fifth set of holes 95 extend through the block in the leg 90*b* perpendicular to and intersecting the holes 91 and 93. The center hole 95 opens into a hexagon shaped recess 100 provided to receive one of the nuts 24. The block 90 has a chamfered outside base corner 101 and spaced therefrom across the leg 90*b* a triangular groove or recess 102 extending parallel to the corner surface 101. The L-shape of the block as defined by its leg portions 90*a* and 90*b* provides a plurality of flat surfaces 91*a*, 92*a*, and 93*a* which lie in different parallel planes. Nuts 24 employed on threaded rods extending through the holes 91, 92, and 93 may all rest against the block 90 and be accessible in a noninterfering relationship by tools such as wrenches used to tighten the nuts. The block 90 has cylindrical surface segments 103 extending in a 90° arc bounding the block portion around the hole 94 and a cylindrical segment surface 104 bounding the block around the hole 92 joining the cylindrical surface segments 103 and extending perpendicular to the plane surface 93*a*. The cylindrical surface segments provide a pleasing appearance to the junction block, permits sufficient material to be formed in the block around the holes 92 and 94 for the necessary strength, and provide a degree of improved access to the surfaces 92*a* and 93*a* aiding in manipulating nuts 24** when engaging such surfaces.

The bridge clamp assembly embodying the features of the invention shown in FIG. 9 utilizes a number of the junction blocks 90 arranged in columns on rods 23 across the work table 51. The bridge clamp arrangement of FIG. 9 is useful to clamp a plurality of work pieces such as the planks 110 to the work table for carrying out a variety of work functions on the planks. The bridge clamp basically involves supporting of a horizontal beam 111 across in parallel relationship with the work table 51 for mounting the pressure feet 22 which engage and hold the planks 110 in place on the work table. The opposite ends of the beam 111 are secured on identical columns 116 and 117 each formed by a vertical threaded rod 23 clamped at the table edge by a pair of vertically spaced junction blocks 90. The junction blocks 90 which engage the work table are secured on the rod 23 which extends through the center hole 91 of the blocks with the leg portions **90*b* of the junction blocks clamping each column to the table. A nut 24 on the rod 23 engages the surface 91*a* of the top block 90 while, similarly, a nut 24 on the rod 23 engages the corresponding surface 91*a* of the bottom block. Tightening the two nuts 24 on the rod 23 urges the top and bottom blocks on the rod tightly against the opposite work table surfaces to rigidly secure each column with the table. An upper pair of junction blocks 90 is similarly secured vertically spaced on the threaded rod 23 on opposite upper and lower edges of the beam 111. Each of the upper blocks 90 is secured on the rod 23 between a pair of the nuts 24. The three pressure 22 illustrated in engagement with the planks 110 is each on the lower end portion of a threaded rod 23 which is suspended from the beam 111 by a pair of the junction blocks 90 which are secured on the rod between nuts 24 along the top and bottom edges of the beam 111. The pressure feet, rod 23, and junction blocks form three more columns 118, 119 annd 120. A nut 24 on each rod 23 in the columns 118, 119, and 120 engages the upper end of each pressure foot 22 so that rotating each nut 24 downwardly on each rod 23 controls the amount of pressure applied by each foot 22 to the plank 110. The use of the flexible band 25 around the leg portions of the pressure feet hold the feet on the rods 23 while the assembly is being erected. Since the rods supporting the pressure feet in this configuration are vertical and the pressure feet are on the lower end of the rods, each foot would fall off of the rods were it not for the bands 25**.

Figure 10:
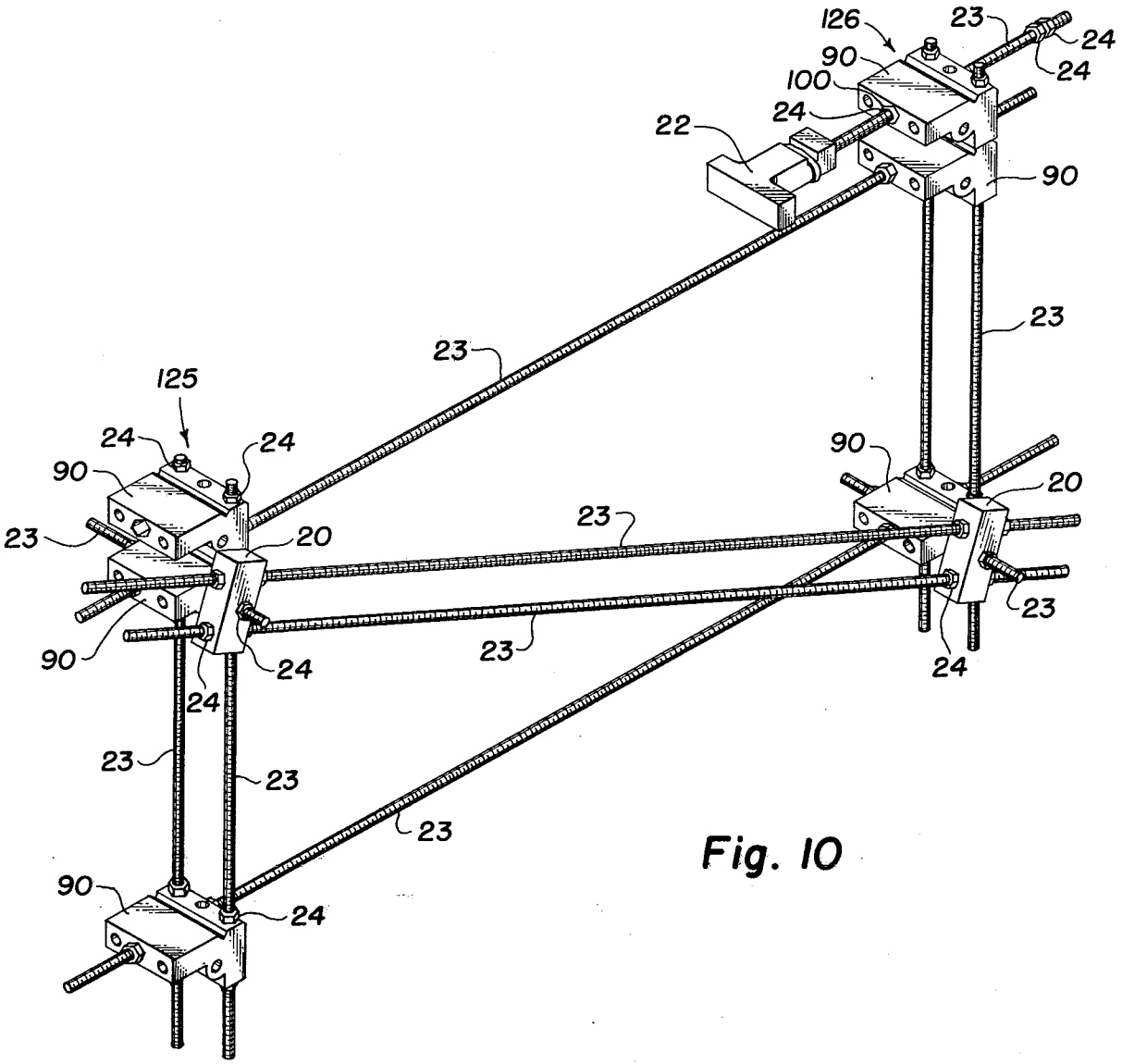
FIG. 10 is another arrangement of the system of the invention utilized as a bar clamp.

FIG. 10 illustrates a bar clamp arrangement of the assembly of the invention utilizing the junction blocks 20 and the junction blocks 90. The basic function of the bar clamp configuration is support of a work piece, not shown, between the pressure foot 22 and the junction block 90 on the top of the left hand column 125 of the structure as shown in FIG. 10. The frame formed with the diagonal reinforcement permits a work piece to be rigidly supported at an elevated position. The assembly includes left and right hand spaced columns 125 and 126 formed by vertical threaded rods 23 secured through a single lower junction block 90 and a pair of upper junction blocks 90. The vertical rods 23 of the columns 125 and 126 extend through the outermost holes 91 in the blocks. The lower blocks 90 are secured on the threaded rods 23 by nuts 24 tightened down on the rods on opposite sides of the blocks. A horizontal threaded rod 23 extends between the bottom blocks of the two columns projecting through the center holes 95 of the blocks. The upper portions of each of the columns 125 and 126 formed by the pairs of the blocks 90 are secured together by nuts 24 on the vertical rods 23. The lower block 90 of each of the column top pairs of blocks are connected together by a horizontal rod 23 secured with the lower blocks of the pairs by nuts 90 on the rod 23 tightened on the rod against the opposite sides of the blocks. In the form of the bar clamp shown in FIG. 10 the top junction block 90 in the column 126 supports a horizontal threaded rod 23 disposed through the center hole 95 for supporting the pressure foot 22 which is engaged on the inward end portion of the rod. A nut 24 on the rod 23 supporting the pressure foot is recessed in the socket 100 of the top block 90 to permit the advance of the pressure foot 22 on the rod by rotation of the rod with a wrench engaging a pair of nuts 24 on the outer free end portion of the rod 23 supporting the pressure foot. Substantial rigidity is provided by a pair of angular threaded rods 23 secured between junction blocks 20 mounted on horizontal rods 23 extending through the hole 94 of the lower junction block 90 in the column 126 and the corresponding hole of the bottom block 90 in the upper pair of junction blocks on the left hand column 125. If desired, the bar clamp arrangement of FIG. 10 may be mounted from a work table such as the table 51 as with the bridge clamp of FIG. 9.

Referring to FIG. 11, a four-corner clamp is shown for holding a four-sided structure 120 together such as when gluing the ends and sides along the corners. This configuration of the clamping assembly of the invention uses the junction blocks 90 in pairs connected together to form corner clamps as illustrated in FIG. 5. As shown in FIG. 5, two of the junction blocks 90 are secured together by a threaded rod 23 which extends through the center hole 91 of one of the blocks and the center hole 95 of the other of the blocks thereby positioning the triangular recess 102 of the first block adjacent to the chamfered corner 101 of a second of the blocks so that the recess and chamfered corner cooperate to form an open-sided rectangular corner relief recess. Four pairs of the blocks 90 secured together as shown in FIG. 5 are placed at the four corners of the structure 120 connected together by threaded rods 23 extending along the sides and across the ends of the structure 120. The rods 23 which extend down the opposite sides 120*a* of the structure 120 between the pairs of corner junction blocks 90 pass through the outer holes 95 in a first of the blocks. The other rods 23 connected with the corner pairs extending across the ends 120*b* pass through both of the blocks in an outer hole 91 of one block and an outer hole 95 of the other of the connected blocks. This will be better understood by reference to FIG. 11 and particularly, by way of example, the lower center pair of blocks forming the corner block assembly on the structure 120 nearest the reader. At such corner the left hand threaded rod 23 extending along the near long side of the structure 120 passes through the lowermost outside bottom hole 95 of the left hand block 90. In the same pair of blocks the right hand threaded rod 23 extending across the short end 120*b* of the structure 120 nearest the reader passes through both of the corner blocks in the top hole 91 of the left hand block and the top hole 95 of the right hand block. It will be recognized from FIG. 5 that when the blocks are connected together to form the corner structure for this form of clamp, the holes 91 of one of the blocks are aligned with the holes 95 of the other of the blocks. The corner relief provided by the cooperation of the triangular recess 102 in one of the blocks with the chamfered corner 101 in the connected block receives the corner edges such as the edge 120*c* of the rectangular structure. Such corner relief is necessary in order for the clamps to seat properly on the corners of the structure and be capable of being tightened to the necessary extent.

It will be seen that in some configurations of the invention the pressure foot is used to apply the holding force including one of the opposing surfaces, while in other forms of the invention, such as the four-corner clamp of FIG. 11, one of the junction blocks functions as the pressure foot.

It will be recognized that other forms of junction blocks and an infinite variety of combinations of the junction blocks, threaded rods, and pressure feet of the system of the invention may be formed within the concept of the invention to provide a wide variety of different types of clamping systems. A workman may improvise to assemble an essentially infinite variety of types and sizes of clamps.

The use of the smooth walled holes through the junction blocks and the blind smooth walled hole in the pressure foot forming a loose fit with the threaded support rods employed in the system of the invention provides for maximum adjustability and self-centering of the junction blocks and pressure foot since the pressure is applied entirely by the action of the threaded nuts on the rods acting against the junction blocks and pressure foot depending upon the particular configuration assembled.

What is claimed is:

1. A clamping system comprising: a pressure foot having a force applying surface, a smooth walled blind hole formed along an axis perpendicular to said force applying surface opening at the opposite end of said pressure foot from said force applying surface, and a transverse slot intersecting said blind hole; a threaded rod engageable along one end with said blind hole in said pressure foot to apply a compression force through said rod to said pressure foot for urging said force applying surface of said pressure foot against a work piece; a flexible band for encircling said pressure foot through said transverse slot of said pressure foot to engage threads on said threaded rod for holding said pressure foot on said rod; a junction block having a first smooth walled hole to receive said threaded rod for supporting said rod while said pressure foot applies said force to said work piece, said junction block having at least one other hole extending in non-parallel, non-intersecting relationship with said first hole for support means for said junction block; and threaded nut means for coupling said junction block with said threaded rod and transmitting a compression force to said rod from said junction block.

* * * * *